US011859938B2

(12) United States Patent
Liao

(10) Patent No.: US 11,859,938 B2
(45) Date of Patent: Jan. 2, 2024

(54) MULTI-CHANNEL MAGAZINE FOR A TOY GUN

(71) Applicant: GUAY GUAY TRADING CO., LTD., New Taipei (TW)

(72) Inventor: Yin-Hsi Liao, Changhua County (TW)

(73) Assignee: GUAY GUAY TRADING CO., LTD., New Taipei (TW)

( * ) Notice: Subject to any disclaimer, the term of this patent is extended or adjusted under 35 U.S.C. 154(b) by 0 days.

(21) Appl. No.: 17/846,545

(22) Filed: Jun. 22, 2022

(65) Prior Publication Data

US 2023/0010513 A1 Jan. 12, 2023

(30) Foreign Application Priority Data

Jul. 12, 2021 (TW) ..... 110125516

(51) Int. Cl.
*F41B 11/55* (2013.01)

(52) U.S. Cl.
CPC ..... *F41B 11/55* (2013.01)

(58) Field of Classification Search
CPC .. F41B 11/50; F41B 11/55; F41A 9/65; F41A 9/69
USPC ..... 124/45, 52, 50, 51.1, 53; 42/18, 49.01, 42/50
See application file for complete search history.

(56) References Cited

U.S. PATENT DOCUMENTS 2,391,756 A * 12/1945 Vesely ..... F41A 9/68 42/50
2,503,116 A * 4/1950 Maillard ..... F41A 9/65 42/50
3,204,361 A * 9/1965 Rocha ..... F41A 9/69 42/50
3,345,771 A * 10/1967 Silsby ..... F41A 9/69 42/50
3,672,089 A * 6/1972 Silsby ..... F41A 9/69 42/50
3,788,191 A * 1/1974 Rose ..... F41A 9/28 89/129.01
4,428,137 A * 1/1984 Johnson ..... F41A 9/69 42/50

(Continued)

FOREIGN PATENT DOCUMENTS

JP 2005106302 4/2005

*Primary Examiner* — Alexander R Niconovich
(74) *Attorney, Agent, or Firm* — Burris Law, PLLC

(57) ABSTRACT

A multi-channel magazine for a toy gun includes a magazine body, a dividing unit formed within the magazine body, and a bullet pressing unit. The dividing unit cooperates with the magazine body to define at least one storage channel, a plurality of first narrow channels in spacial communication with the storage channel, and a converging channel in communication with the first narrow channels and a bullet outlet. Each of the first narrow channels and the converging channel is configured to allow only one bullet to pass through. The bullet pressing unit is mounted on the magazine body to press the bullets from the storage channel through the first narrow channels and discharge the bullets from the converging channel. The bullets can be moved and converged gradually to a one-by-one arrangement to the bullet outlet so as to facilitate smooth pressing and discharging of bullets and increase the capacity of magazine.

8 Claims, 10 Drawing Sheets

(56) References Cited

U.S. PATENT DOCUMENTS

| | | | | |
|---|---|---|---|---|
| 8,739,446 | B2 * | 6/2014 | Sullivan | F41A 9/69<br>42/50 |
| 8,839,706 | B1 * | 9/2014 | Macy | F42B 6/10<br>89/33.17 |
| 10,718,582 | B2 * | 7/2020 | Sharkov | F41A 9/70 |
| 2006/0180134 | A1 * | 8/2006 | Illuzzi | F41A 9/24<br>102/502 |
| 2007/0261688 | A1 * | 11/2007 | Tam | F41B 11/55<br>124/52 |

* cited by examiner

MULTI-CHANNEL MAGAZINE FOR A TOY GUN

CROSS-REFERENCE TO RELATED APPLICATION

This application claims priority of Taiwanese Patent Application No. 110125516, filed on Jul. 12, 2021.

FIELD

The disclosure relates to a magazine for a toy gun, and more particularly to a multi-channel magazine for receiving and holding bullets.

BACKGROUND

A conventional magazine disclosed in JP 2005106302 generally includes a bullet outlet, an accommodating space for filling and receiving numerous bullets, an alignment slot extending toward the bullet outlet for arranging the bullets closely and alternately packed in two rows therein, a moving port in spacial communication with the accommodating space and the alignment slot, and a spring-biased pressing unit disposed in the alignment slot to press the bullets. Through tilting the magazine, the bullets flow into the alignment slot from the accommodating space through the moving port.

Although a large number of bullets are filled in the accommodating space and arranged in numerous rows to increase the capacity of the magazine, only the bullets received in the alignment slot are loaded to fire, and frequent tilting operations for loading the bullets in the alignment slot are unavoidable. Moreover, the accommodating space is fixed in dimension, which cannot meet any requirement of usage.

SUMMARY

Therefore, an object of the disclosure is to provide a multi-channel magazine that can alleviate at least one of the drawbacks of the prior art.

According to the disclosure, the multi-channel magazine for a toy gun adapted to receive numerous bullets includes a magazine body, a dividing unit and a bullet pressing unit. The magazine body is elongated in a lengthwise direction, and has a bullet outlet. The dividing unit is formed within the magazine body and cooperates with the magazine body to define within the magazine body at least one storage channel which extends in the lengthwise direction, a plurality of first narrow channels which are in spacial communication with the at least one storage channel, and a converging channel which is formed downstream of the first narrow channels and in spacial communication with the bullet outlet. The storage channel is configured to arrange the bullets held therein in a width direction such that a plurality of rows of the bullets are arranged in the storage channel. Each of the first narrow channels and the converging channel has a width configured to allow only one of the bullets to pass through. The number of the first narrow channels is M, and the number of rows of the bullets in the storage channel is R, wherein M<R. The bullet pressing unit is mounted on the magazine body to press the bullets from the storage channel through the first narrow channels and discharge the bullets from the converging channel.

With the multiple channels in the magazine body, the bullets can be moved and converged gradually to a one-by-one arrangement in one row to the bullet outlet, which facilitates smooth pressing and discharging of the bullets and increases the capacity of magazine.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
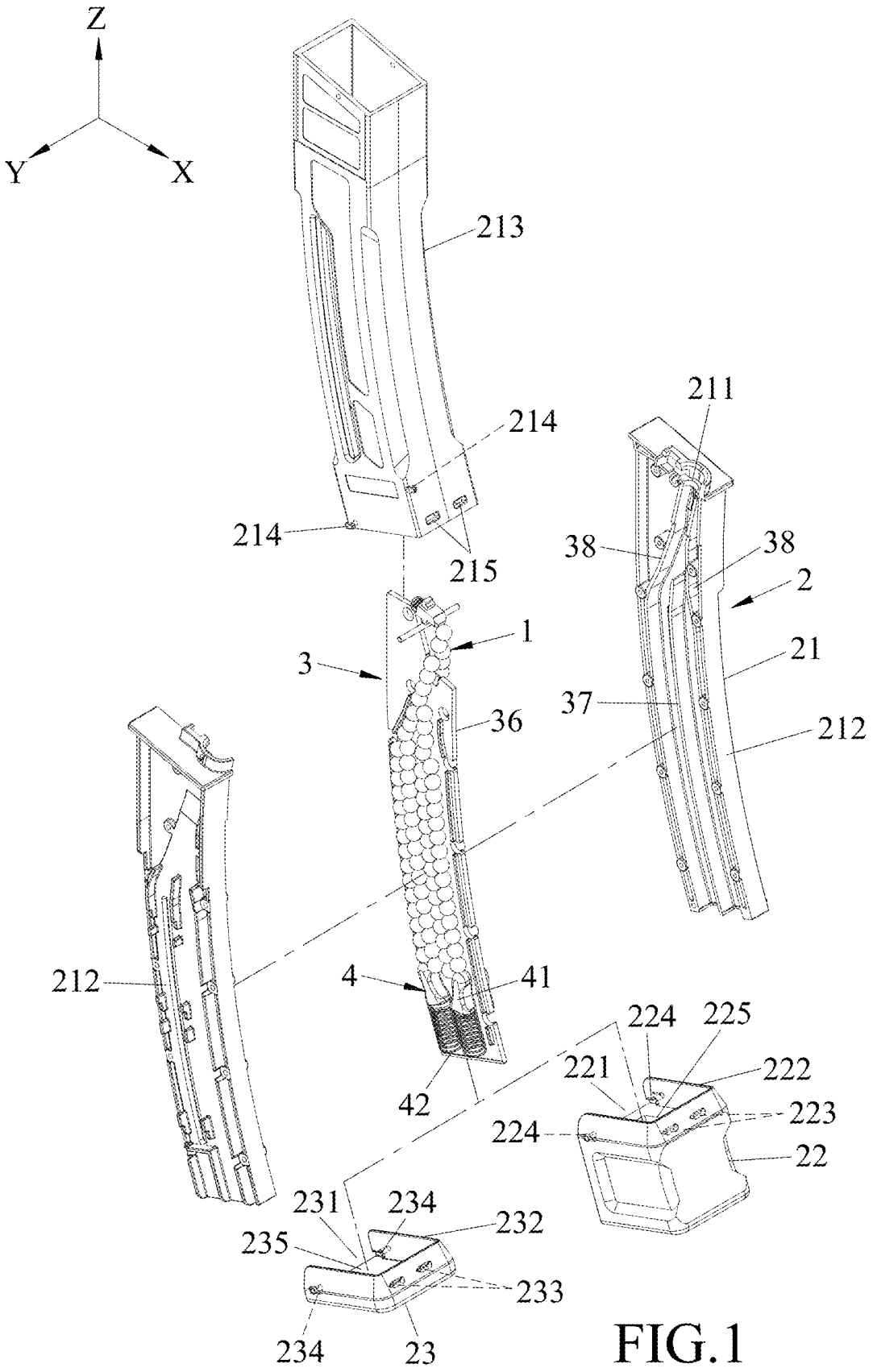
FIG. 1 is an exploded perspective view illustrating an embodiment of a multi-channel magazine for a toy gun according to the disclosure.
Figure 2:
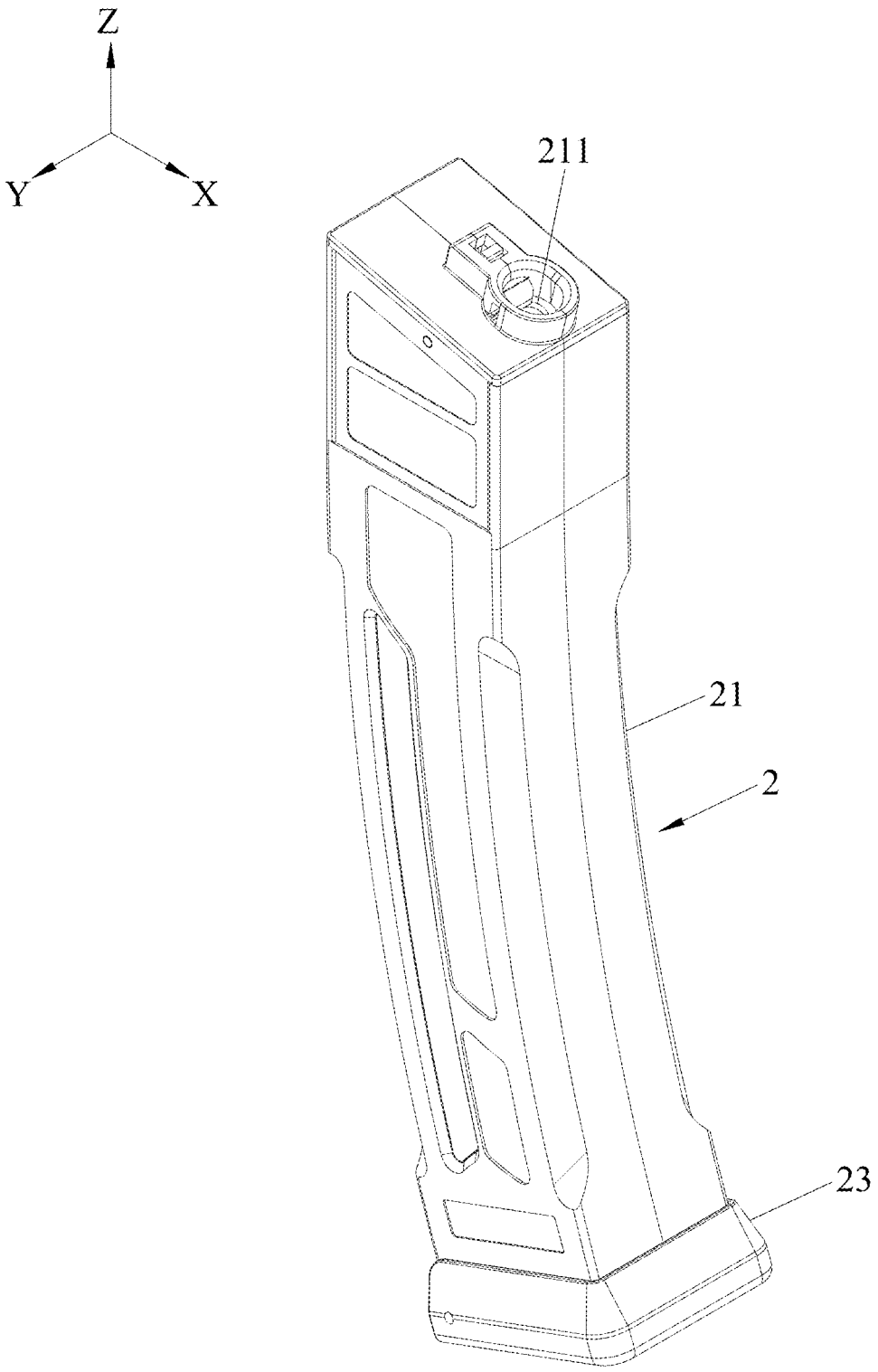
FIG. 2 is a perspective view of a portion of the embodiment.

Referring to FIGS. 1 and 2, an embodiment of a multi-channel magazine for a toy gun according to the disclosure is adapted to receive numerous bullets 1 and includes a magazine body 2, a dividing unit 3 and a bullet pressing unit 4.

With reference to FIGS. 1, 3, 4 and 5, the magazine body 2 is elongated in a lengthwise direction (Z), and includes a magazine housing 21, an expansion housing 22 and a magazine cap 23.

The magazine housing 21 includes two magazine body halves 212 which are coupled with each other to define a bullet outlet 211 therebetween, and an outer sleeve 213 which surrounds and is sleeved around the magazine body halves 212. In this embodiment, the bullet outlet 211 is formed at an end face to discharge the bullets 1 therefrom. The outer sleeve 213 has two protrusions 214 which are respectively formed at two sides thereof in a front-rear direction (Y), and two grooves 215 which are formed at an end thereof and opposite to the protrusions 214 in a width direction (X) and further opposite to the bullet outlet 211 in the lengthwise direction (Z). In this embodiment, the lengthwise direction (Z), the width direction (X) and the front-rear direction (Y) are perpendicular to one another.

Figure 9:
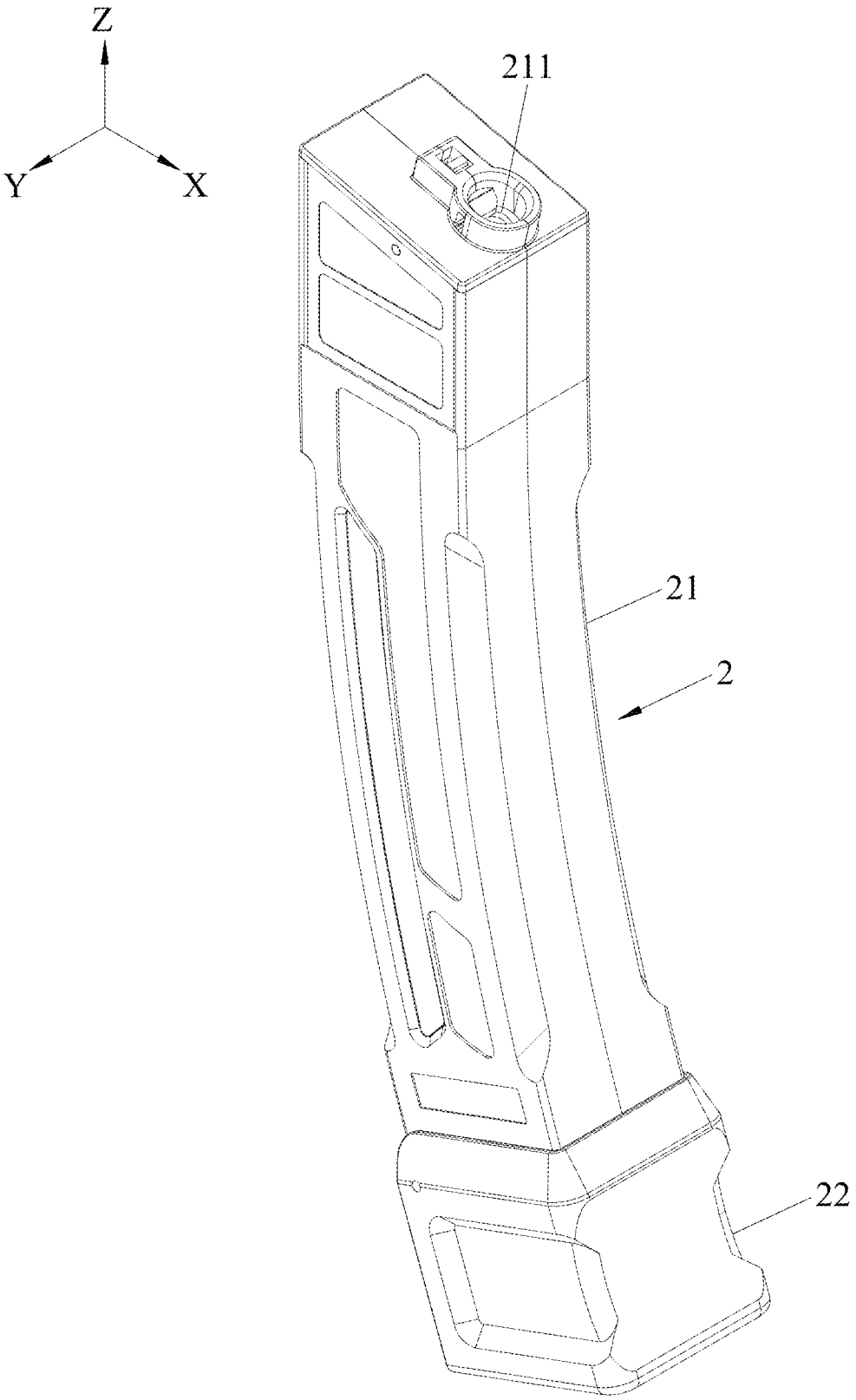
FIG. 9 is a perspective view similar to FIG. 2, illustrating a state when an expansion housing is mounted on a magazine housing.

Each of the expansion housing 22 and the magazine cap 23 is selectively and removably connected with and mounted on the magazine housing 21 in the lengthwise direction (Z) (as shown in FIGS. 2 and 9). The expansion housing 22 has a first sleeve 222 of a U-shape which defines a first mounting opening 221 for sleeving on the magazine housing 21 from the first mounting opening 221, two first hooks 223 which are formed on an inner surface of the first sleeve 222 to be respectively engageable with the grooves 215, two first slots 224 which are formed in the inner surface of the first sleeve 222 to be respectively engageable with the protrusions 214, and four expansion channels 225 which are opened toward one side thereof.

The magazine cap 23 has a second sleeve 232 of a U-shape which defines a second mounting opening 231 for sleeving on the magazine housing 21 from the second mounting opening 231, two second hooks 233 which are formed on an inner surface of the second sleeve 232 to be respectively engageable with the grooves 215, two second slots 234 which are formed in the inner surface of the second sleeve 232 to be respectively engageable with the protrusions 214, and a wall 235 which extends transverse to the second sleeve 232.

Figure 3:
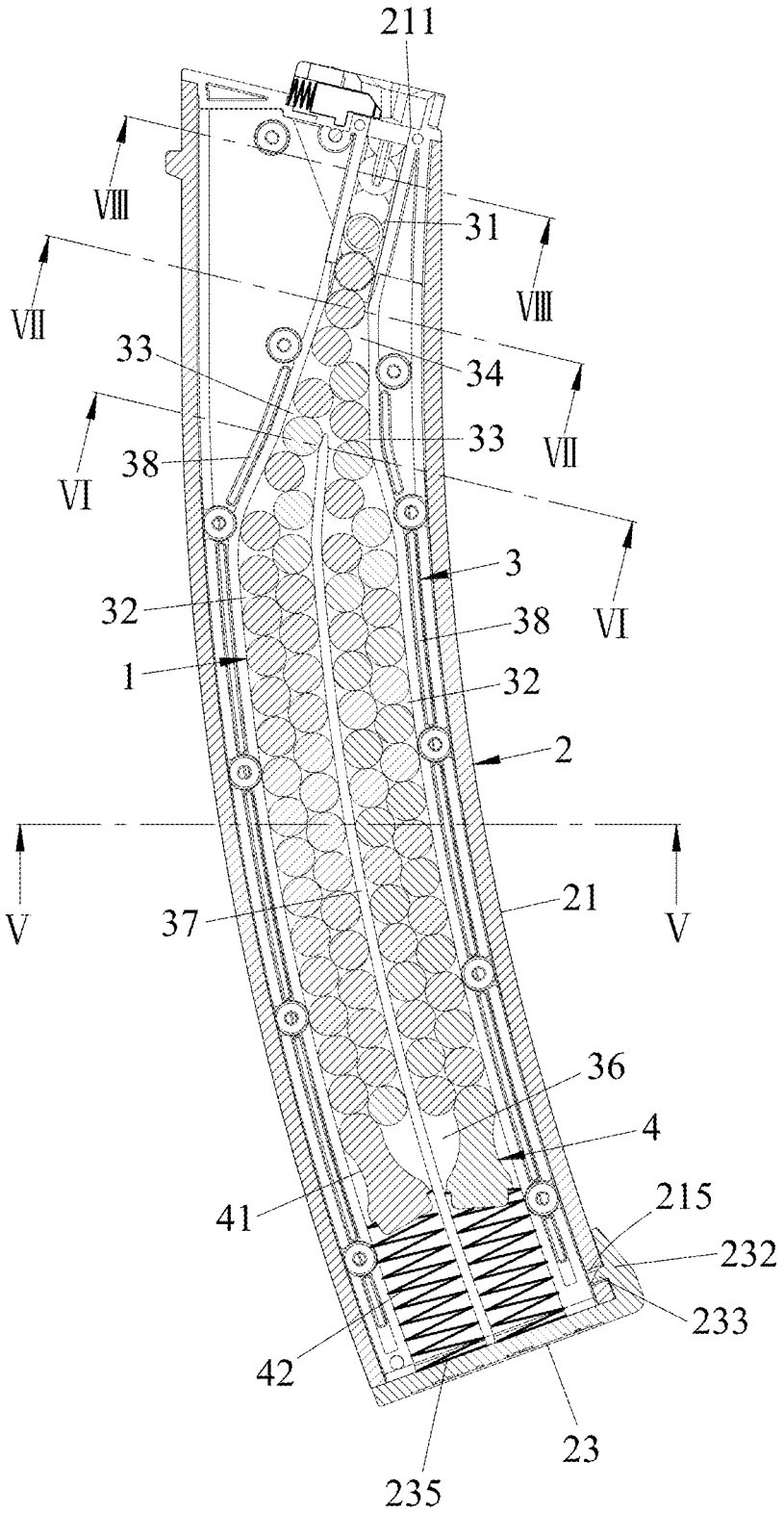
FIG. 3 is a sectional view of the portion of the embodiment.
Figure 4:
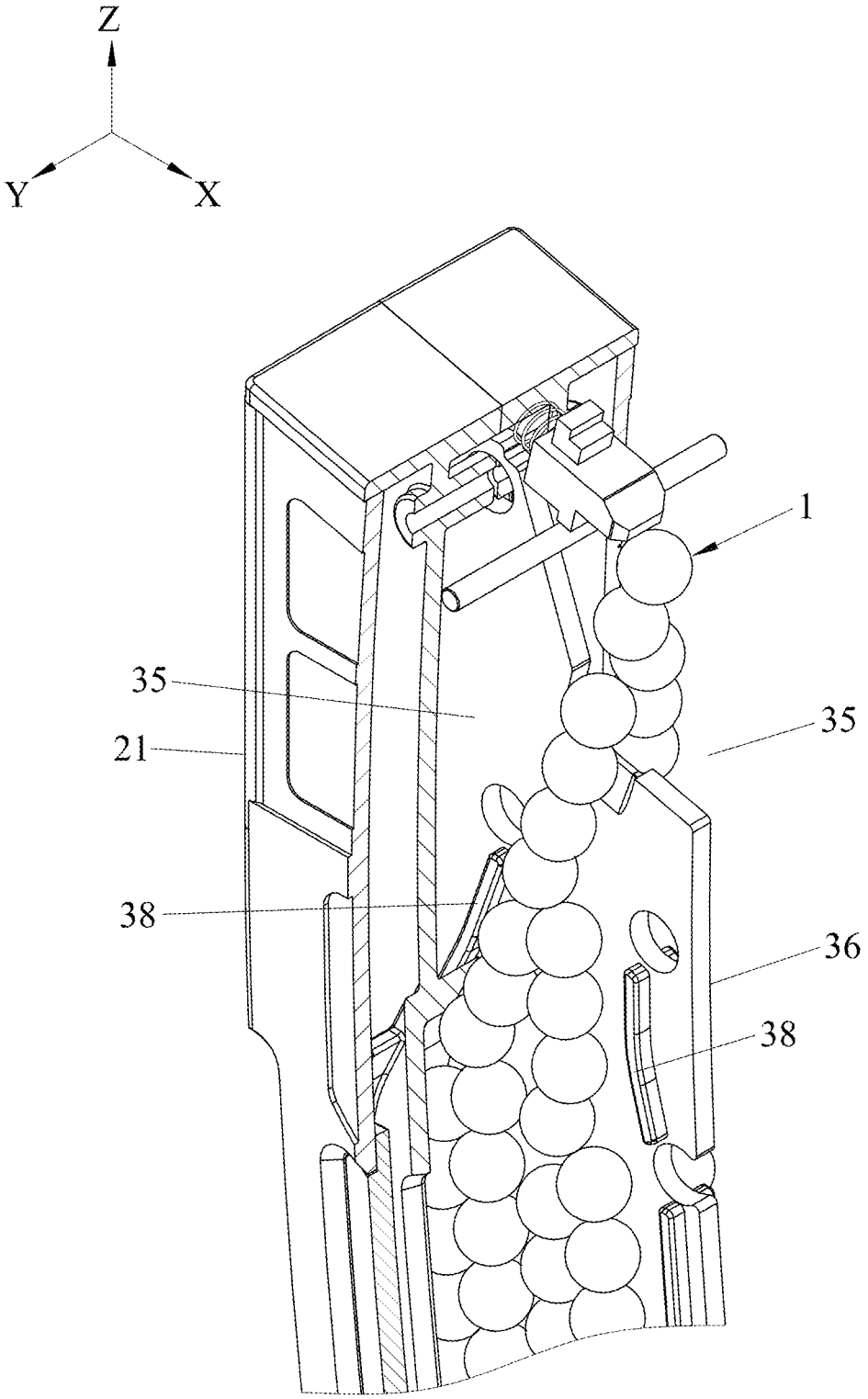
FIG. 4 is a fragmentary, partly-sectioned perspective view of the embodiment.
Figure 5:
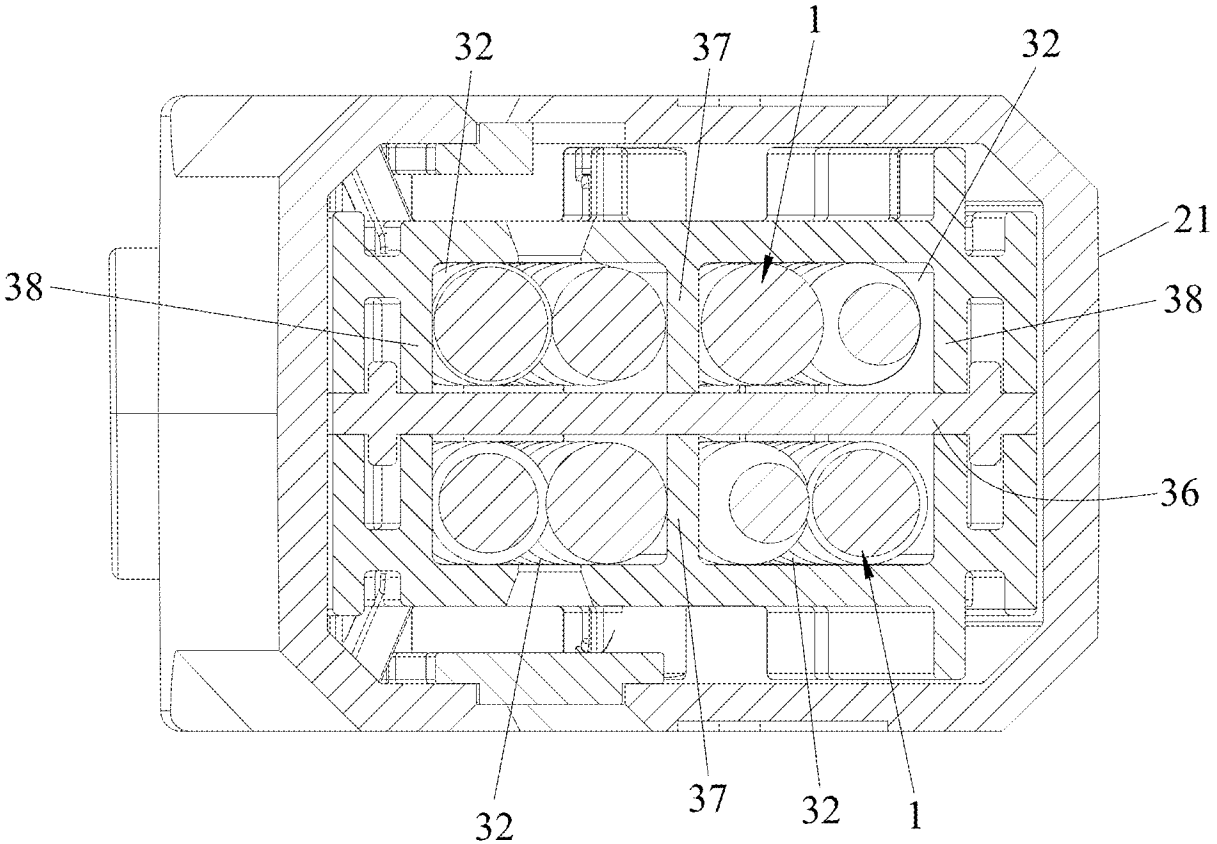
FIG. 5 is a sectional view taken from line V-V of FIG. 3.
Figure 6:
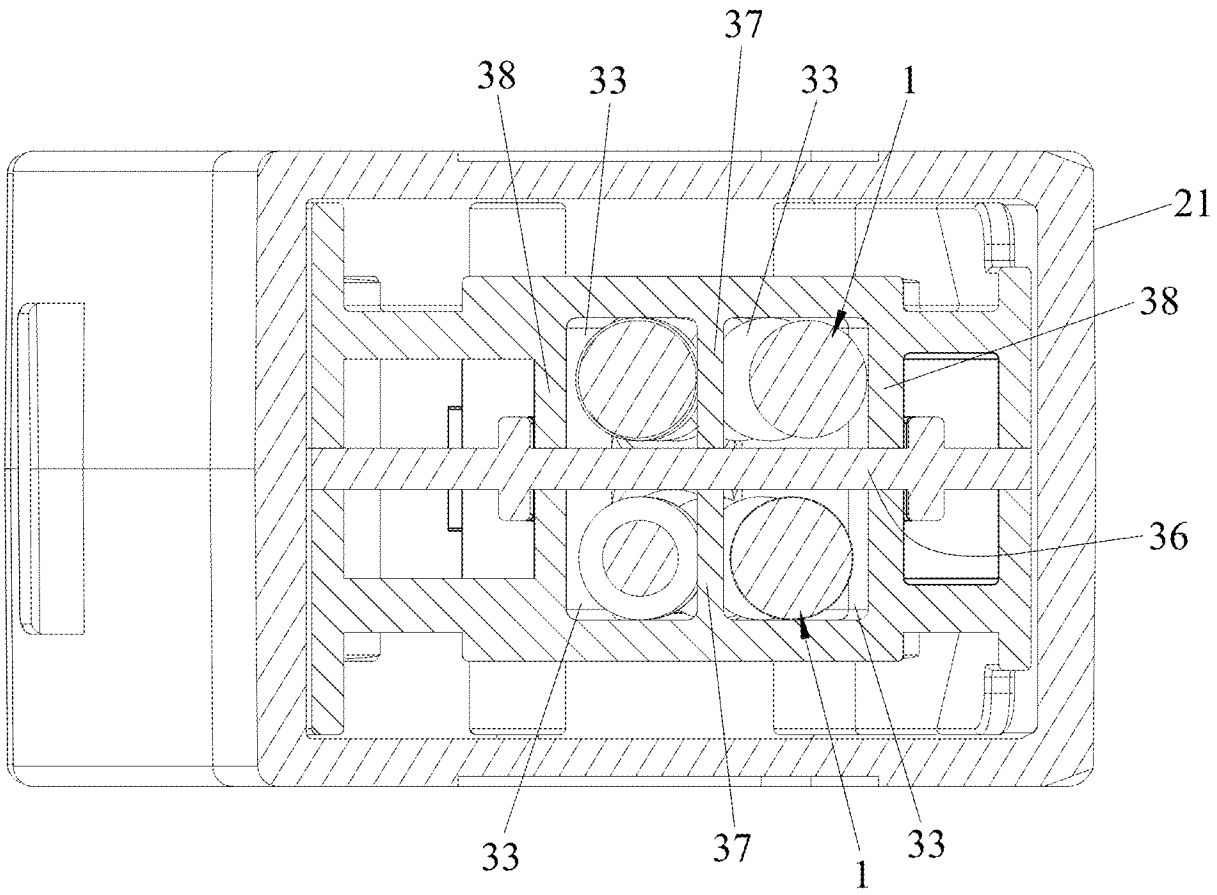
FIG. 6 is a sectional view taken from line VI-VI of FIG. 3.
Figure 7:
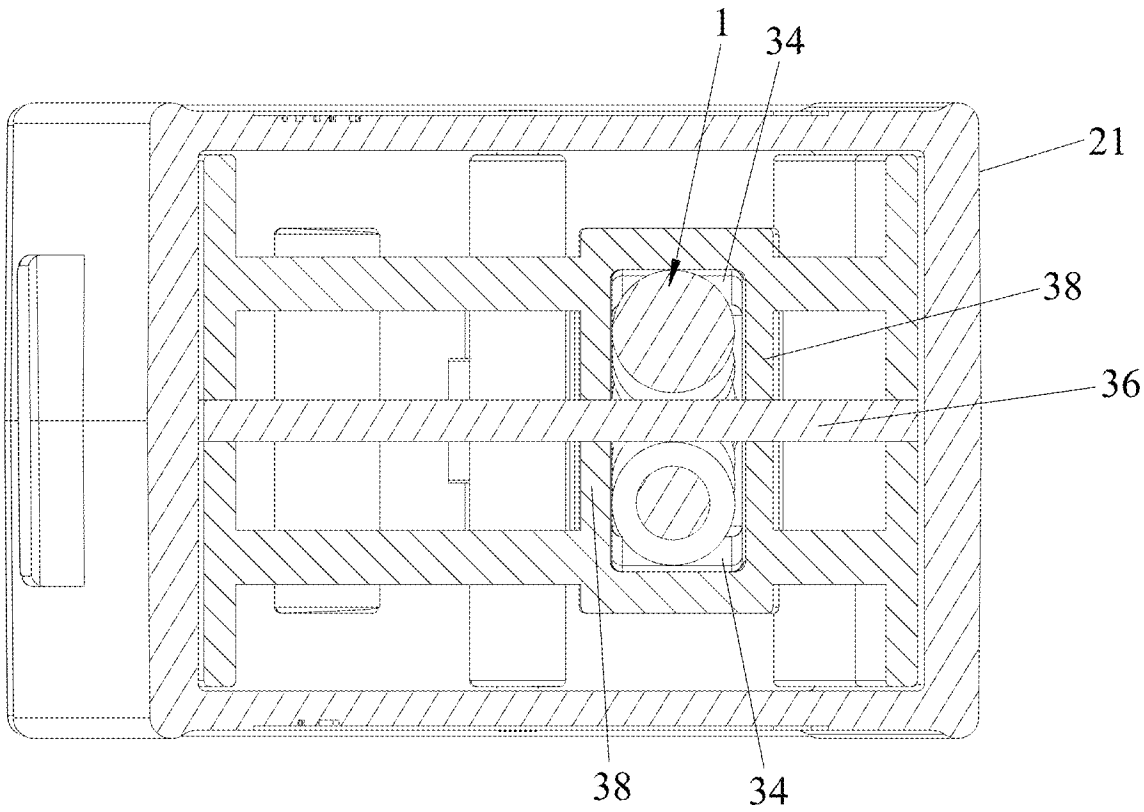
FIG. 7 is a sectional view taken from line VII-VII of FIG. 3.
Figure 8:
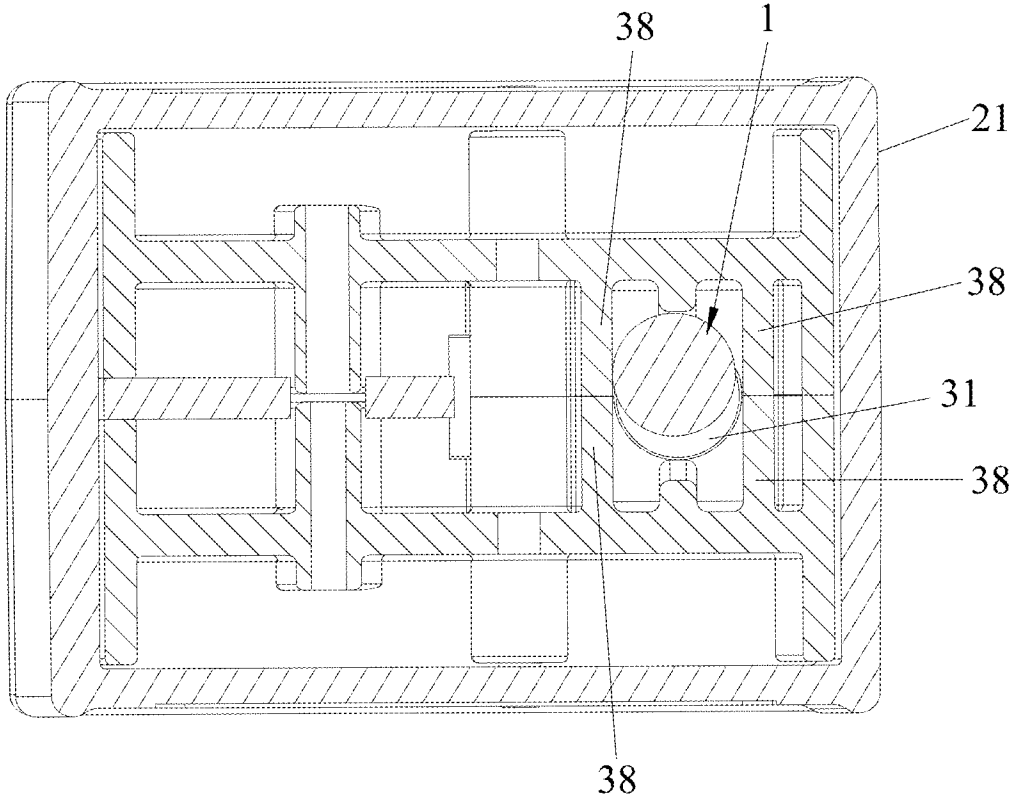
FIG. 8 is a sectional view taken from line VIII-VIII of FIG. 3.

With reference to FIGS. 1, 3 and 4, the dividing unit 3 is formed within the magazine housing 21 and cooperates with the magazine housing 21 to define within the magazine housing 21 a converging channel 31 which is in spacial communication with the bullet outlet 211, a plurality of storage channels 32 (the number of the storage channels 32 is S) which extend in the lengthwise direction (Z), a plurality of first narrow channels 33 (the number of the first narrow channels 33 is M) which are in spacial communication with the storage channels 32, and a plurality of second narrow channels 34 (the number of the second narrow channels 34 is N) which are formed downstream of the first narrow channels 33 and upstream of the converging channel 31. The storage channels 32 are configured to arrange the bullets 1 filled and held therein in the width direction (X) such that a plurality of rows of the bullets 1 (the number of rows of the bullets 1 is R) are arranged in the storage channels 32. Each of M, N and R is even, and R>S>N, S=M. In this embodiment, for example, R=8, and S=M=4. That is, within the magazine housing 21, by the dividing unit 3, four storage channels 32, four first narrow channels 33 and two second narrow channels 34 are formed, and two rows of the bullets 1 are arranged in each storage channel 32 such that eight rows of the bullets 1 can be filled in the storage channels 32.

Moreover, each of the first narrow channels 33, the second narrow channels 34 and the converging channel 31 has a width configured to allow only one of the bullets 1 to pass through.

With reference to FIGS. 1, 3, 4 and 5, in this embodiment, the dividing unit 3 includes a dividing plate 36 which is disposed within and divides the magazine housing 21 into two half compartments 35, and two dividing ribs 37 which extend transversely from the dividing plate 36 and each of which divides a respective one of the half compartments 35 into two of the storage channels 32. The dividing unit 3 further includes four guiding rib assemblies 38. Each guiding rib assembly 38 extends from at least one of the magazine housing 21 and the dividing plate 36 in the front-rear direction (Y), and has a plurality of rib portions arranged in the lengthwise direction (Z). Each two of the guiding rib assemblies 38 are disposed within the corresponding half compartment 35 and are spaced apart from the corresponding dividing rib 37 in the width direction (X) to cooperate with the corresponding dividing rib 37 to define within the corresponding half compartment 35 two of the first narrow channels 33 and one of the second narrow channels 34. Specifically, the two of the guiding rib assemblies 38 extend and are converged toward each other to define within the corresponding half compartment 35 the second narrow channel 34.

The bullet pressing unit 4 is mounted on the magazine body 2, and includes four pressing elements 41 and four biasing elements 42. Each pressing element 41 is adapted to press the bullets 1. Each biasing element 42 is disposed between the magazine body 2 and the respective pressing element 41 to urge the corresponding pressing element 41 to move toward the bullet outlet 211.

With reference to FIGS. 1 and 3, when the magazine cap 23 is connected with and mounted on the magazine housing 21, each pressing element 41 is movably disposed in the respective storage channel 32, and each biasing element 42 is disposed between and abuts against the respective pressing element 41 and the wall 235 of the magazine cap 23. Thus, the pressing elements 41 press the bullets 1 from the storage channels 32 through the first and second narrow channels 33, 34 and discharge the bullets 1 from the converging channel 31. During this, as shown in FIGS. 4 to 8, the eight rows of the bullets 1 arranged in the storage channels 32 enter the first narrow channels 33 and are arranged to four rows. Then, the four rows of the bullets 1 in the first narrow channels 33 enter the second narrow channels 34 and are arranged to two rows. Subsequently, the two rows of the bullets 1 in the second narrow channels 34 enter the converging channel 31 and are converged in one row. Finally, as shown in FIG. 3, the bullets 1 are discharged one by one from the bullet outlet 211.

Referring to FIGS. 1 and 3, it is noted that, when the magazine cap 23 is mounted on the magazine housing 21, the magazine cap 23 is connected with the magazine housing 21 in the front-rear direction (Y) from the second mounting opening 231 while the second hooks 233 are engaged with the grooves 215 and the second slots 234 are engaged with the protrusions 214 for the magazine cap 23 to be securely sleeved on the magazine housing 21. Likewise, the magazine cap 23 is forced in a direction away from the magazine housing 21 to disengage the second hooks 233 and second slots 234 from the grooves 215 and the protrusions 214 for the magazine cap 23 to be removed from the magazine housing 21.

Figure 10:
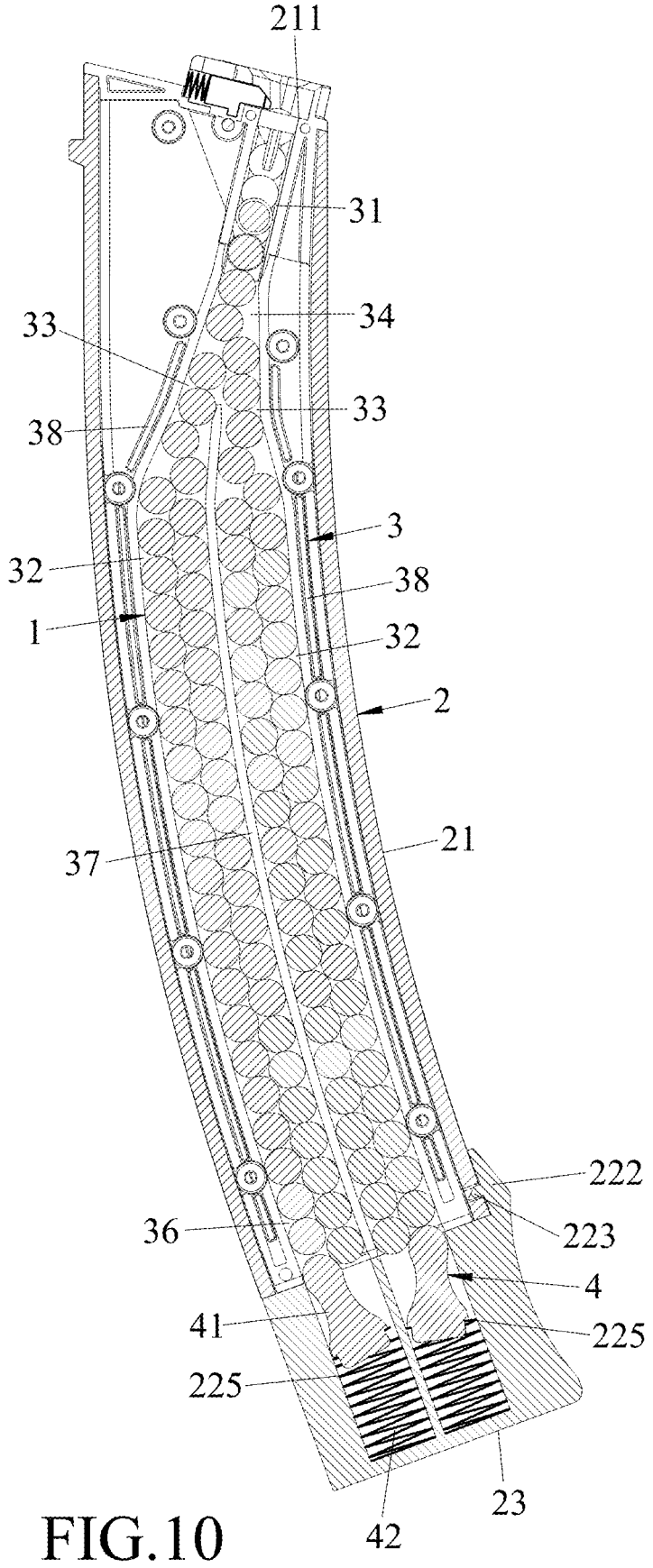
FIG. 10 is a sectional view similar to FIG. 3, illustrating a state when a plurality of biasing elements are mounted between a plurality of pressing elements and the expansion housing.

With reference to FIGS. 1, 9 and 10, when the expansion housing 22 is connected with and mounted on the magazine housing 21, each expansion channel 225 is in spacial communication with the respective storage channel 32, each pressing element 41 is movably disposed in the respective expansion channel 225 and the respective storage channel 32, and each biasing element 42 is disposed between the respective pressing element 41 and the expansion housing 22. Thus, the pressing elements 41 press the bullets 1 by virtue of the biasing action of the biasing elements 42 from the expansion channels 225 and through the storage channels 32, the first narrow channels 33 and the second narrow channels 34, and the bullets 1 then enter the converging channel 31 to be discharged from the bullet outlet 211.

It is noted that, during assembling of the expansion housing 22, the pressing elements 41 and the biasing elements 42 are respectively moved down into the expansion channels 225 from the storage channels 32 when the expansion housing 22 is mounted on and connected with the magazine housing 21. Alternatively, the pressing elements 41 and the biasing elements 42 may be removed from the magazine housing 21 when the magazine cap 23 is detached from the magazine housing 21, and are moved into the expansion channels 225 of the expansion housing 22.

Moreover, when the expansion housing 22 is mounted on the magazine housing 21, the expansion housing 22 is connected with the magazine housing 21 in the front-rear direction (Y) from the first mounting opening 221 while the first hooks 223 are engaged with the grooves 215 and the first slots 224 are engaged with the protrusions 214 for the expansion housing 22 to be securely sleeved on the magazine housing 21. Likewise, the expansion housing 22 is forced in a direction away from the magazine housing 21 to disengage the first hooks 223 and the first slots 224 from the grooves 215 and the protrusions 214 for the expansion housing 22 to be removed from the magazine housing 21.

The number of the storage channels 32 and the expansion channels 225 may not be limited to four. In other embodiments, it may be two, three or more than four.

As illustrated, with the storage channels 32 each for receiving and filling two rows of the bullets 1, the capacity of the magazine is increased. With the pressing element 41 and the biasing element 42 disposed in the respective storage channel 32, the bullets 1 can be pressed toward the bullet outlet 211 without the need to frequently fill bullets in the magazine so as to decrease the times of bullet filling operation. Moreover, with the first narrow channels 33 and the second narrow channels 34, eight rows of the bullets 1 can be rearranged and converged to four rows in the first narrow channels 33, and then to two rows in the second narrow channels 34. Hence, the bullets 1 can be moved and converged gradually to a one-by-one arrangement in one row in the converging channel 31, which can avoid jostling of the bullets 1 against one another to smoothly press and discharge the bullets 1. Furthermore, with the expansion housing 22 and the movable pressing unit 4, the magazine housing 21 is selectively connected with one of the magazine cap 23 and the expansion housing 22 to meet the capacity requirement of usage.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A multi-channel magazine for a toy gun adapted to receive numerous bullets, comprising:

a magazine body elongated in a lengthwise direction, and having a bullet outlet;

a dividing unit formed within said magazine body and cooperating with said magazine body to define within said magazine body a plurality of storage channels which extend in the lengthwise direction, a plurality of first narrow channels which are in spacial communication with said at least one storage channel, a converging channel which is formed downstream of said first narrow channels and in spacial communication with said bullet outlet, and a plurality of second narrow channels which are formed downstream of said first narrow channels and upstream of said converging channel, each of said storage channels being configured to arrange the bullets held therein in a width direction such that a plurality of rows of the bullets are arranged in each of said storage channels, each of said first narrow channels, said second narrow channels and said converging channel having a width configured to allow only one of the bullets to pass through, the number of said first narrow channels being M, the number of rows of the bullets in each of said storage channels being R, the number of said storage channels is S, the number of said second narrow channels is N, wherein each of M and N is even, R>S>N, and S=M; and a bullet pressing unit mounted on said magazine body to press the bullets from said storage channels through said first narrow channels and said second narrow channels and discharge the bullets from said converging channel.

2. The multi-channel magazine as claimed in claim 1, wherein said dividing unit includes a dividing plate which is disposed within and divides said magazine body into two half compartments, and two dividing ribs which extend transversely from said dividing plate and each of which divides a respective one of said half compartments into two of said storage channels.

3. The multi-channel magazine as claimed in claim 2, wherein said dividing unit further includes four guiding rib assemblies, each of said guiding rib assemblies extending from at least one of said magazine body and said dividing plate in a front-rear direction, two of said guiding rib assemblies being disposed within a respective one of said half compartments and spaced apart from a corresponding one of said dividing ribs in the width direction to cooperate with said corresponding dividing rib to define within said corresponding half compartment two of said first narrow channels, the lengthwise direction, the width direction and the front-rear direction being perpendicular to one another.

4. The multi-channel magazine as claimed in claim 3, wherein said two of said guiding rib assemblies extend and are converged toward each other to define within said corresponding half compartment said at least one second narrow channel, said bullet pressing unit including a plurality of pressing elements and a plurality of biasing elements, each of said pressing elements being disposed in said at least one storage channel, each of said biasing elements being disposed between said magazine body and a respective one of said pressing elements to urge said corresponding pressing element to move toward said bullet outlet.

5. The multi-channel magazine as claimed in claim 1, wherein said magazine body includes a magazine housing, an expansion housing and a magazine cap, said magazine housing having said bullet outlet, each of said expansion housing and magazine cap being selectively and removably connected with and mounted on said magazine housing in the lengthwise direction, said expansion housing defining therein a plurality of expansion channels which are opened toward one side thereof, said bullet pressing unit including a plurality of pressing elements and a plurality of biasing elements, wherein, when said expansion housing is connected with and mounted on said magazine housing, said expansion channels are in spacial communication with said storage channels, respectively, each of said pressing elements is movably disposed in a respective one of said expansion channels and the respective one of said storage channels, and each of said biasing elements is disposed between a respective one of said pressing elements and said expansion housing, and wherein, when said magazine cap is connected with and mounted on said magazine housing, each of said pressing elements is movably disposed in the respective one of said storage channels, and each of said biasing elements is disposed between a respective one of said pressing elements and said magazine cap.

6. The multi-channel magazine as claimed in claim 5, wherein each of said biasing elements is movably disposed in the respective one of said expansion channels and the respective one of said storage channels.

7. The multi-channel magazine as claimed in claim 5, wherein said magazine housing further has two protrusions which are respectively formed at two sides thereof in a front-rear direction, and at least one groove which is formed at an end thereof and opposite to said protrusions in the width direction, said at least one groove being spaced apart from said bullet outlet in the lengthwise direction, said expansion housing having a first sleeve which defines a first mounting opening for sleeving on said magazine housing from said first mounting opening, at least one first hook which is formed on an inner surface of said first sleeve to be engageable with said groove, and two first slots which are formed in said inner surface of said first sleeve to be respectively engageable with said protrusions, the lengthwise direction, the width direction and the front-rear direction being perpendicular to one another.

8. The multi-channel magazine as claimed in claim 7, wherein said magazine cap has a second sleeve which defines a second mounting opening for sleeving on said magazine housing from said second mounting opening, at least one second hook which is formed on an inner surface of said second sleeve to be engageable with said groove, two second slots which are formed in said inner surface of said second sleeve to be respectively engageable with said protrusions, and a wall which extend transverse to said second sleeve for said biasing elements to abut thereagainst.

* * * * *